United States Patent [19]

Nakamura et al.

[11] 4,149,368

[45] Apr. 17, 1979

[54] ELECTRONIC TIMEPIECE WITH NEGATIVE RESISTANCE LIGHT EMITTING ELEMENTS

[75] Inventors: Tutomu Nakamura, Akashi; Kiyoshi Kumata; Hidetoshi Maeda, both of Tenri, all of Japan

[73] Assignee: Sharp Kabushiki Kaisha, Osaka, Japan

[21] Appl. No.: 667,656

[22] Filed: Mar. 17, 1976

[30] Foreign Application Priority Data

Mar. 17, 1975 [JP] Japan ..... 50-36136

[51] Int. Cl.[2] ..... G04C 17/00

[52] U.S. Cl. ..... 58/50 R; 58/127 R

[58] Field of Search ..... 58/50 R, 127 R, 128; 340/324 R, 366 R

[56] References Cited

U.S. PATENT DOCUMENTS

| | | | |
|---|---|---|---|
| 3,258,906 | 7/1966 | Demby | 58/50 R |
| 3,742,699 | 7/1973 | Bergey | 58/50 R |
| 3,894,389 | 7/1975 | Miura et al. | 58/50 R |
| 3,922,847 | 12/1957 | Culley et al. | 58/50 R |
| 3,955,354 | 5/1976 | Kilby et al. | 58/50 R |

*Primary Examiner*—Stanley J. Witkowski

*Attorney, Agent, or Firm*—Birch, Stewart, Kolasch and Birch

[57] ABSTRACT

A time calculation ring counter is made of a plurality of negative resistance light emitting elements, which provide display of current time information. In a preferred form, a plurality of GCR's (gallium arsenide gate controlled rectifiers) or a plurality of GND's (gallium arsenide negative resistance light emitting diodes) are aligned in a circular fashion on a display panel of an electronic timepiece. The GCR's or GND's function to either calculate the time information or indicate the time information.

9 Claims, 4 Drawing Figures

ELECTRONIC TIMEPIECE WITH NEGATIVE RESISTANCE LIGHT EMITTING ELEMENTS

BACKGROUND AND SUMMARY OF THE INVENTION

The present invention relates to an electronic timepiece including a set of negative resistance light emitting elements, which function to either calculate the time information or indicate the time information.

The conventional electronic wristwatch usually comprises hour, minute and second hands associated with a step motor, or a digital display unit for indicating time information in a digital fashion.

In the former type, a mechanical assembly is unavoidably required and, therefore, it is difficult to obtain an electronic wristwatch of compact size. Moreover, the reliability is low because of its mechanical part. In the latter type, shift resisters and a driver circuit are unavoidably required in addition to the digital display unit and, therefore, the circuit construction thereof is complicated.

Accordingly, an object of the present invention is to provide an electronic timepiece with simple circuit construction.

Another object of the present invention is to provide an electronic timepiece of high reliability.

Still another object of the present invention is to provide an electronic timepiece of which a time calculation means functions as an indication means.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to an embodiment of the present invention, a set of negative resistance light emitting elements such as GCR's (gallium arsenide gate controlled rectifiers) or GND's (gallium arsenide negative resistance light emitting diodes) are aligned in a circular fashion on a display panel of an electronic timepiece for indicating current time information. The negative resistance light emitting elements also perform the time calculation operation and, therefore, a driver circuit for the display purpose can be omitted.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
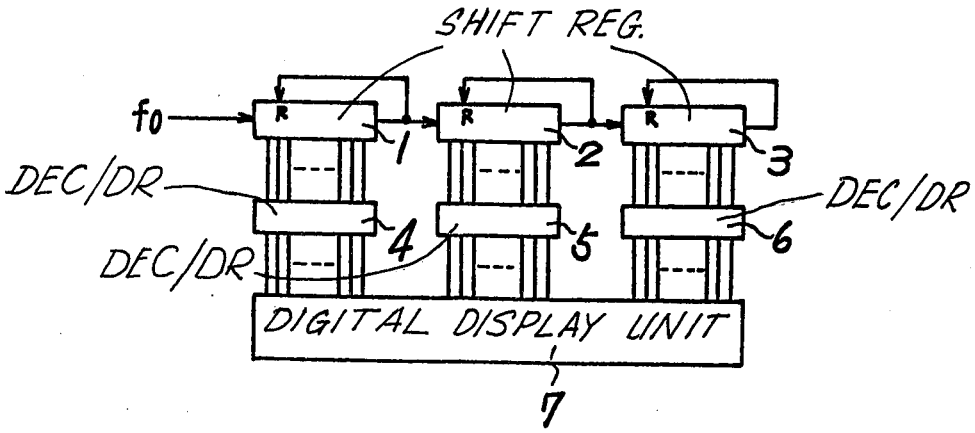
FIG. 1 is a schematic circuit diagram of an electronic timepiece of the prior art.

Referring now in detail to the drawings, and to facilitate a more complete understanding of the present invention, an electronic circuitry of an electronic timepiece of the prior art will be first described with reference to FIG. 1.

A reference frequency signal $f_0$ is sequentially applied to shift registers 1, 2 and 3, which store time information as to seconds, minutes and hours, respectively. Thus stored time information in the respective shift registers 1, 2 and 3 is supplied to a digital display unit 7 made of, for example, a liquid crystal display via decoder/driver circuits 4, 5 and 6. In the above-mentioned circuitry, the shift registers 1, 2 and 3 and the decoder/driver circuits 4, 5 and 6 are required in addition to the digital display unit 7.

Figure 2:
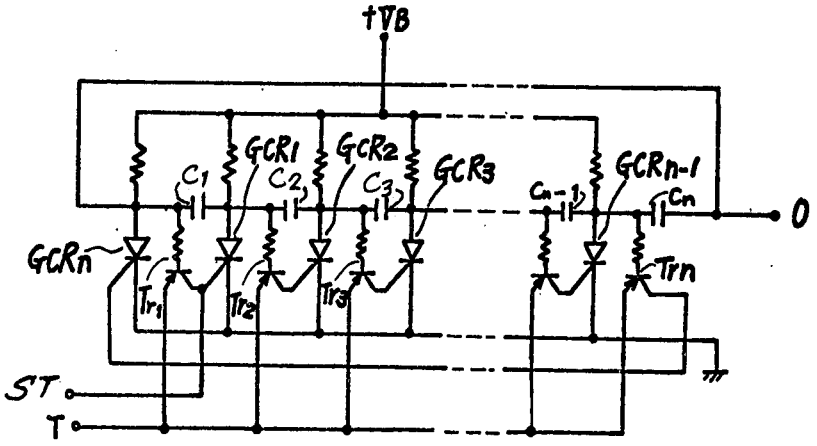
Prior Art FIG. 2
FIG. 2 is a circuit diagram of an embodiment of a ring counter employed in an electronic timepiece of the present invention.

FIG. 2 shows an embodiment of a ring counter of the present invention comprising gate controlled negative resistance light emitting elements. A GCR (gallium arsenide gate controlled rectifier) is well known as one of the gate controlled negative resistance light emitting elements.

The ring counter comprises the gallium arsenide gate controlled rectifiers $GCR_1$, $GCR_2$, . . ., and $GCR_n$; transistors $Tr_1$, $Tr_2$, . . ., and $Tr_n$ for triggering the $GCR_1$, $GCR_2$, . . ., and $GCR_n$; capacitors $C_1$, $C_2$. . ., $C_n$; an input terminal ST for receiving a start pulse; another input terminal T for receiving trigger pulses; and an output terminal O for developing a carry signal.

Figure 3:
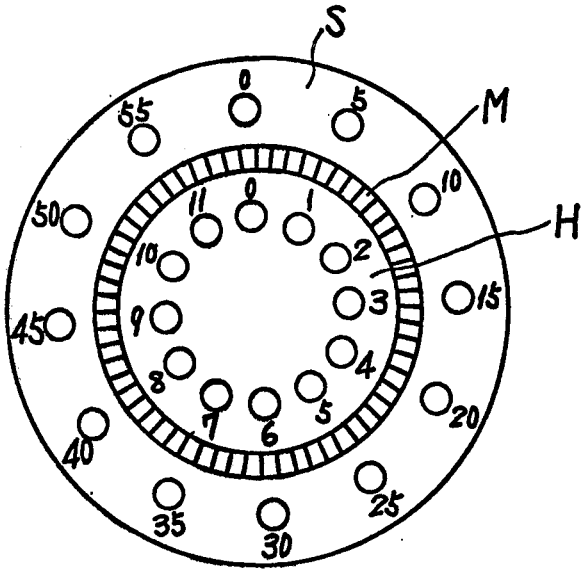
FIG. 3 is a plan view of an embodiment of a display panel of an electronic timepiece of the present invention.

Such ring counters are serially connected with each other and indicate time information as to hours, minutes and seconds. FIG. 3 shows an example of the alignment of the GCR's on the display panel of an electronic timepiece. In this example twelve (12) GCR's are provided for hour information indication H, sixty (60) GCR's are provided for minute information indication M, and twelve (12) GCR's are provided for second information indication S, the second information indication S being changed every five (5) seconds.

The operation mode of the ring counter shown in FIG. 2 is as follows:

Initially, all of the GCR's are in their OFF conditions. Therefore, the transistor $Tr_1$ receives a voltage signal of a high level at its base electrode and, hence, the transistor $Tr_1$ is maintained at its OFF state even when the trigger pulse is applied to the transistor $Tr_1$ through the input terminal T. When the start pulse appears at the input terminal ST, the $GCR_1$ is directly triggered by this start signal and turned ON. At this moment, a voltage level of the anode of the $GCR_1$ becomes low, thereby to charge up the capacitor $C_2$ with a result that the anode of the $GCR_2$ is maintained at a high level whereas the base electrode of the transistor $Tr_2$ is maintained at a low level. Therefore, the transistor $Tr_2$ is in a condition in which it will be turned on when the trigger pulse appears at the input terminal T.

Under these conditions, only the transistor $Tr_2$ is turned on when the trigger pulse is supplied from the input terminal T, thereby to trigger the $GCR_2$. At this moment the capacitor $C_3$ is charged up to render the voltage level applied to the gate electrode of the transistor $Tr_3$ low, and render the voltage level applied to the anode of the $GCR_3$ high. This results in that the transistor $TR_3$ will be turned on by the following trigger pulse. At the same time the capacitor $C_2$ is charged up in the direction to backward bias the $GCR_1$, whereby the $GCR_1$ is turned off. When the $GCR_1$ becomes OFF, the voltage level of the anode of the $GCR_1$ becomes high and, consequently, the transistor $Tr_2$ is turned off. In such a manner the GCR's are sequentially turned on upon every appearance of the trigger pulse, and the GCR's provide indication of time information by their light emission.

Figure 4:
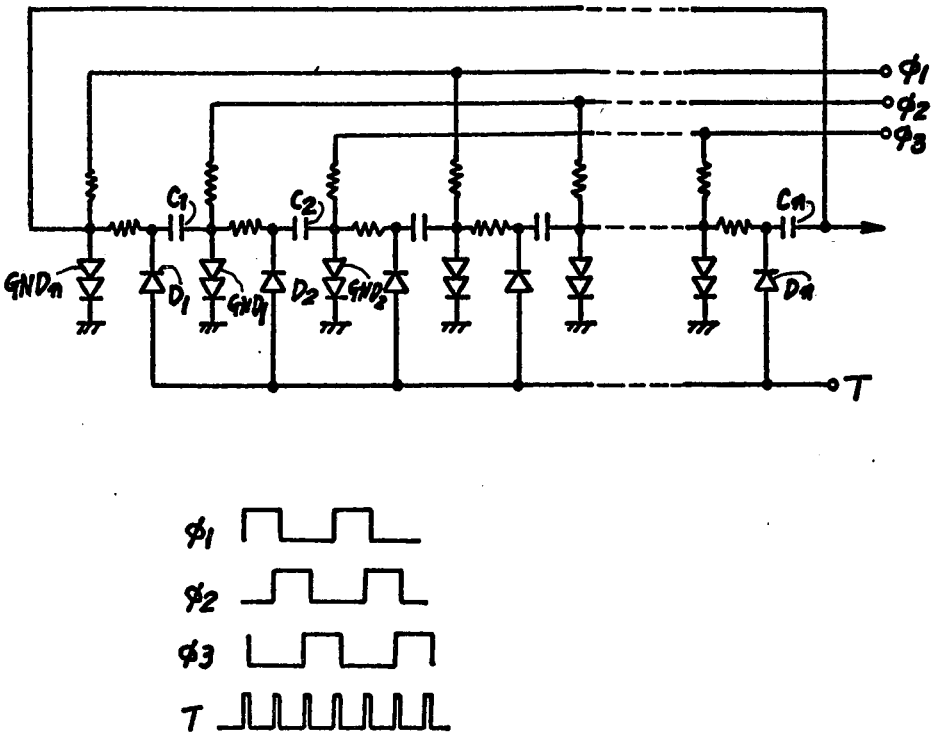
FIG. 4 is a circuit diagram of another embodiment of a ring counter employed in an electronic timepiece of the present invention.

FIG. 4 shows another embodiment of a ring counter of the present invention comprising negative resistance light emitting elements. A GND (gallium arsenide negative resistance light emitting diode) is well known in the art as one of the negative resistance light emitting elements.

The memory characteristics of such negative resistance light emitting diodes (GND's) are described in U.S. Pat. No. 3,913,098 for "Light Emitting Four Layer Device and Improved Circuitry Thereof" issued Oct. 14, 1975; as well as in U.S. Pat. No. 3,757,174 for "Light Emitting Four Layer Semiconductor Device" issued Sept. 24, 1973, which clearly refers to the "memory" function of such devices as the GND's of the present invention at column 8, line 41; and in U.S. Pat. No. 3,655,988 "Negative Resistance Light Emitting Switching Devices" issued Apr. 11, 1972, which further illustrates the bistable or memory characteristics of such devices. Thus, the GND's of the present invention constitute combined memory and display elements.

The ring counter comprises a set of gallium arsenide negative resistance light emitting diodes $GND_1$, $GND_2$, . . ., $GND_n$; a set of diodes $D_1$, $D_2$, . . ., $D_n$; a set of capacitors $C_1$, $C_2$, . . ., $C_n$; an input terminal T for receiving trigger pulses; and input terminals $\phi_1$, $\phi_2$ and $\phi_3$ for receiving clock pulses of different phases. The GND's are sequentially turned on upon every appearance of the trigger pulse in a same manner as of the embodiment of FIG. 2 with the use of the clock pulses $\phi_1$ through $\phi_3$. The GND, which is now turned on, emits light for indicating the current time information.

The invention being thus described, it will be obvious that the same may be varied in many ways. Such variations are not to be regarded as a departure from the spirit and scope of the inventon, and all such modifications are intended to be included within the scope of the following claims.

What is claimed is:

1. A combined time calculating and display means for an electronic timepiece having a source of reference frequency signals, said means comprising:

a ring counter having input means for receiving reference signals from said source and generating a time sequence count in response thereto; and said counter further comprising a plurality of negative resistance light emitting elements interconnected in a ring counter configuration to define sequential counting elements therein, each of said elements comprising a combined memory and display element and being responsive to said reference signals and being self-illuminated in response to said reference signals to display a given time count while actively controlling same in said counter in response to said reference signals.

2. The invention of claim 1, wherein the negative resistance light emitting elements are disposed on a display panel of the electronic timepiece.

3. The invention of claim 2, wherein the negative resistance light emitting elements are aligned in a circular configuration.

4. The invention of claim 1, wherein the negative resistance light emitting elements are gate controlled negative resistance rectifiers.

5. The invention of claim 4, wherein the gate controlled negative resistance rectifiers are gallium arsenide gate controlled rectifiers.

6. The invention of claim 5, wherein the gallium arsenide gate controlled rectifiers are disposed on a display panel of the electronic timepiece in a circular configuration.

7. The invention of claim 1, wherein the negative resistance light emitting elements are negative resistance light emitting diodes.

8. The invention of claim 7, wherein the negative resistance light emitting diodes are gallium arsenide negative resistance light emitting diodes.

9. The invention of claim 8, wherein the gallium arsenide negative resistance light emitting diodes are disposed on a display panel of the electronic timepiece in a circular configuration.

* * * * *